US006919546B2

(12) United States Patent
Lee

(10) Patent No.: US 6,919,546 B2
(45) Date of Patent: Jul. 19, 2005

(54) MICROWAVE OVEN HAVING AN UPPER AND A LOWER PANEL PART

(75) Inventor: Suk-Hee Lee, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 114 days.

(21) Appl. No.: 10/303,036

(22) Filed: Nov. 25, 2002

(65) Prior Publication Data

US 2003/0234250 A1 Dec. 25, 2003

(30) Foreign Application Priority Data

Jun. 24, 2002 (KR) ..... 2002-35234

(51) Int. Cl.[7] ..... H05B 6/68

(52) U.S. Cl. ..... 219/702; 219/720; 219/756; 219/506; 99/325

(58) Field of Search ..... 219/702, 719, 219/720, 756, 506; 99/325, 451

(56) References Cited

U.S. PATENT DOCUMENTS 4,131,786 A * 12/1978 Cooper ..... 219/506
5,171,948 A * 12/1992 Ishii ..... 219/720
5,864,120 A * 1/1999 Vroom et al. ..... 219/720
6,242,724 B1 6/2001 Lee ..... 219/756
6,337,469 B1 * 1/2002 Chung ..... 219/506

FOREIGN PATENT DOCUMENTS

JP 54-146043 * 11/1979 ..... 219/720
JP 63-294686 * 12/1988 ..... 219/720

* cited by examiner

*Primary Examiner*—Philip H. Leung
(74) *Attorney, Agent, or Firm*—Staas & Halsey LLP

(57) ABSTRACT

A microwave oven includes a control panel having a separate upper and lower panel parts. The control panel comprises the upper panel part and the lower panel part which are separate from each other. A display unit is arranged on, for example, the upper panel part, and a manipulation unit is arranged on, for example, the lower panel part, thus establishing the control panel. During a production of the microwave oven, one of variously designed upper panel parts and one of variously designed lower panel parts can be selected and combined to form the control panel. Accordingly, the microwave oven can have a customizable control panel with customizable features.

20 Claims, 5 Drawing Sheets

MICROWAVE OVEN HAVING AN UPPER AND A LOWER PANEL PART

CROSS-REFERENCE TO RELATED APPLICATIONS

This application claims the benefit of Korean Patent Application No. 2002-35234 filed on Jun. 24, 2002, in the Korean Intellectual Property Office, the disclosure of which is incorporated herein by reference.

BACKGROUND OF THE INVENTION

1. Field of the Invention

The present invention relates to microwave ovens, and more particularly, to a microwave oven having a control panel which is provided at a front wall of the oven and divided into upper and lower panel parts. The upper and lower panel parts are selected from a plurality of pre-manufactured upper and lower panel parts having a variety of appearances, thus providing for a microwaves oven having a customizable control panel.

2. Description of the Related Art

Generally, a microwave oven is an electrically operated oven which heats and/or cooks food laid in its cooking cavity by using high-frequency electromagnetic waves generated by an oscillation of a magnetron installed in a machine room. That is, during an operation of the microwave oven, the magnetron inside the machine room of the microwave oven radiates the high-frequency electromagnetic waves, so-called "microwaves," throughout the cooking cavity. The microwaves penetrate the food so as to repeatedly change a molecular arrangement of moisture existing in the food, thus causing the molecules of the moisture to vibrate and generate a frictional heat to cook the food.

FIG. 1 shows an exploded perspective view of a microwave oven having a conventional control panel. As shown in the drawing, the microwave oven comprises a housing 10, with a cooking cavity 11 defined inside the housing 10 and used to cook food therein. A machine room 12 is also defined inside the housing 10 and receives a variety of devices used to generate microwaves, which are transmitted into the cooking cavity 11 to heat and cook the food. The housing 10 is open at a top and at both sides thereof, and the open top and open sides of the housing 10 are covered with an outer casing 20. A door 25 is hinged to a front wall 13 of the housing 10 so as to open or close the cooking cavity 11. A control panel 30 is provided at the front wall 13 of the housing 10 at a position adjacent to the door 25, and allows a user to control the operation of the microwave oven.

The housing 10 comprises the front wall 13, a rear wall 14 and an inner casing 15 arranged between the front and rear walls 13 and 14 so as to define the cooking cavity 11.

The machine room 12 includes a plurality of devices, such as a magnetron 16, a high-tension transformer 17 and a high-tension condenser 18, to generate the microwaves which are transmitted into the cooking cavity 11 to heat and cook the food therein.

The outer casing 20 covers the open top and open sides of the housing 10 to establish an appearance of the microwave oven. The outer casing 20 comprises one top wall 21 and two sidewalls 22 and 23. The front wall 13 of the housing 10 has first and second openings 13*a* and 13*b*. The first opening 13*a* is opened or closed using the door 25, while the second opening 13*b* allows a rear surface of the control panel 30 to communicate with the interior of the machine room 12.

A front surface of the control panel 30 comprises upper and lower portion, which respectively house a display unit 31 and a manipulation unit 32. The upper and lower portions are integrated with each other and form a single structure. The display unit 31 informs a user of cooking information, while the manipulation unit 32 has a plurality of control buttons which allow a user to select a desired cooking mode and a desired cooking time. A PCB (Printed Circuit Board, not shown) is provided on the rear surface of the control panel 30 to control the operation of the microwave oven in response to input signals transmitted from the manipulation unit 32, thus allowing the microwave oven to perform a selected cooking mode.

However, in the conventional microwave oven, the display unit 31 and the manipulation unit 32 are respectively arranged in a single control panel 30, at upper and lower portions of the control panel 30, which is in a form of a single structure. Accordingly, the appearances of the conventional control panel 30 are limited in designs, and do not meet the requirements of consumers who desire to have microwave ovens with variously designed control panels.

That is, since the upper and lower portions of the conventional microwave oven, which respectively house the display unit 31 and the manipulation unit 32, are integrally formed on a front surface of the single control panel 30, and consumers may desire to purchase microwave ovens with variously designed control panels, it is necessary for a manufacturer of microwave ovens to design an excessive number of control panels having different appearances. However, it is almost impossible for a manufacturer to design such an excessive number of control panels having different appearances. Therefore, conventional microwave ovens do not meet the market demands of the consumers.

Accordingly, microwave ovens having such a control panel with integrated display and manipulation units have poor market competitiveness, as most consumers prefer products with special designs or customizable designs over generic and limited factory designs.

SUMMARY OF THE INVENTION

Accordingly, an aspect of the present invention is to provide a microwave oven having a control panel which is divided into upper and lower panel parts so as to selectively mix and match upper and lower panel parts having a variety of appearances. Such a microwave oven provides for a specialized or customizable control panel.

Additional aspects and advantages of the invention will be set forth in part in the description which follows and, in part, will be obvious from the description, or may be learned by practice of the invention.

To achieve the above and/or other aspects of the present invention, there is provided a microwave oven comprising a housing which establishes an appearance of the oven, a heating unit to cook food, and a control panel mounted to a front wall of the housing, and comprising an upper panel part and a lower panel part which are separate from each other.

In the microwave oven, a display unit may be arranged on the upper panel part and a manipulation unit may be arranged on the lower panel part, thus establishing the control panel.

The upper panel part may be selected from a plurality of pre-manufactured upper panel parts with corresponding display units having different appearances, and the lower panel part may be selected from a plurality of pre-manufactured lower panel parts with corresponding manipulation units having different appearances and/or manipulation methods.

In the microwave oven, a plurality of hooks may be formed along a rear surface of each of first and second side edges of each of the upper and lower panel parts, and a plurality of hooking holes may be formed on the housing so as to engage with the corresponding hooks of the upper and lower panel parts to mount the upper and lower panel parts to the housing.

The upper panel part may include a downward extending lower protrusion which is formed at a rear portion of a lower end of the upper panel part, and the lower panel part may include a recess which is formed at a rear portion of an upper end of the lower panel part, so as to receive the downward extending lower protrusion and mount the upper and lower panel parts to the housing.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
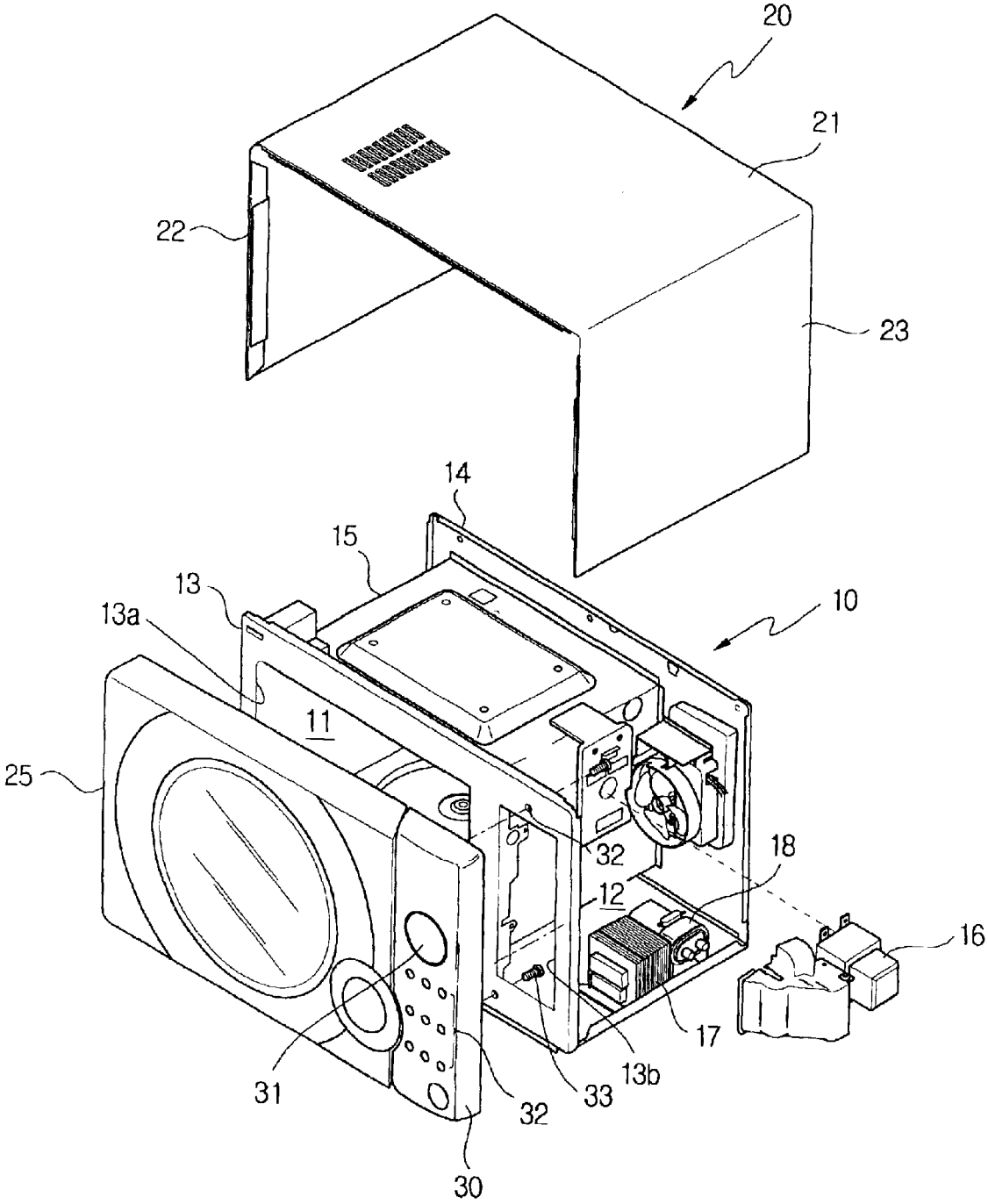
FIG. 1 (Prior Art)
FIG. 1 is an exploded perspective view of a microwave oven having a conventional control panel.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
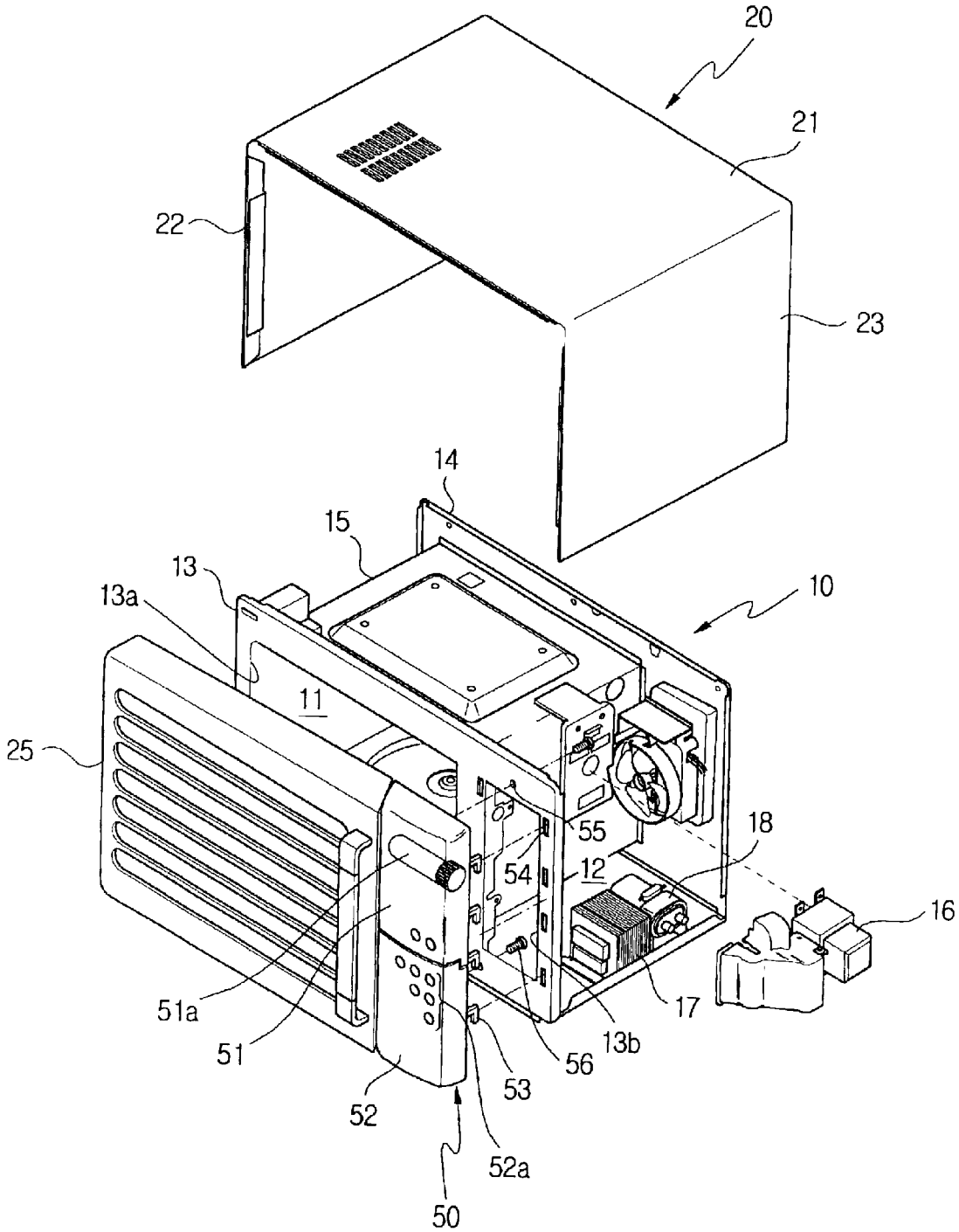
FIG. 2 is an exploded perspective view of a microwave oven having a control panel according to an embodiment of the present invention.

FIG. 2 shows an exploded perspective view of a microwave oven having a control panel according to an embodiment of the present invention. As shown in the drawing, the microwave oven comprises a housing 10 having a front wall 13, a rear wall 14 and an inner casing 15 arranged between the front and rear walls 13 and 14, so as to separately define a cooking cavity 11 and a machine room 12 in the housing 10. The above housing 10 is open at a top and both sides thereof, and the open top and open sides of the housing 10 are covered with an outer casing 20 having one top wall 21 and two sidewalls 22 and 23. The outer casing 20 establishes the appearance of the microwave oven.

The machine room 12 includes a plurality of devices, including a magnetron 16, a high-tension transformer 17 and a high-tension condenser 18 which generate microwaves that are transmitted into the cooking cavity 11 to heat and cook food therein.

The front wall 13 of the housing 10 has first and second openings 13*a* and 13*b*. A door 25 is hinged to the front wall 13 to open or close the first opening 13*a*, while a control panel 50 of this invention is attached to the front wall 13 at the second opening 13*b*.

The control panel 50 comprises upper and lower panel parts 51 and 52, which are separate from each other and are attached to the front wall 13 of the housing 10 so as to cover the upper and lower portions of the second opening 13*b*, respectively. A display unit 51*a*, which displays cooking information, may be arranged on the upper panel part 51, and a manipulation unit 52*a*, which allows a user to select a desired cooking mode and a desired cooking time, may be arranged on the lower panel part 52. However, it is understood that different arrangements may be provided, including arranging the display unit 51*a* on the lower panel part 52 and the manipulation unit 52*a* on the upper panel part 51.

A plurality of hooks 53 may be formed along a rear surface of each of first and second side edges of each of the upper and lower panel parts 51 and 52, so as to have each of the hooks 53 extend rearward from said rear surface to a predetermined length and be perpendicularly bent downward at the rear end thereof. To engage with the hooks 53 of the upper and lower panel parts 51 and 52, a plurality of hooking holes 54 may be formed along both side edges of the second opening 13*b* formed on the front wall 13 of the housing 10, at positions corresponding to the hooks 53. A first screw hole 55 is formed on each of upper and lower edges of the second opening 13*b*, and a second screw hole (not shown) is formed on the rear surface of each of the upper and lower panel parts 51 and 52 at a position corresponding to an associated first screw hole 55. Therefore, attachment of the upper and lower panel parts 51 and 52 to the front wall 13 of the housing 10 may be accomplished by inserting the hooks 53 into the corresponding hooking holes 54, prior to screwing the panel parts 51 and 52 to the front wall 13 using set screws 56 corresponding to the screw holes 55.

Where the upper and lower panel parts 51 and 52 are attached to the front wall 13 of the housing 10, so as to cover the second opening 13*b*, a passage which extends from the rear surfaces of the two panel parts 51 and 52 to the machine room 12 is formed by the second opening 13*b*. A first PCB (not shown) which is associated with the display unit 51*a* is installed on the rear surface of the upper panel part 51 having the display unit 51*a*, and a second PCB (not shown) which is associated with the manipulation unit 52*a* is installed on the rear surface of the lower panel part 52 having the manipulation unit 52*a*. The first and second PCBs are electrically connected so as to be operated in conjunction with one another. The control panel 50, having the above-mentioned construction, controls the devices installed in the machine room 12 in accordance with a selected cooking mode and a selected cooking time, and allows the microwave oven to appropriately cook the food laid in the cooking cavity 11.

Figure 3:
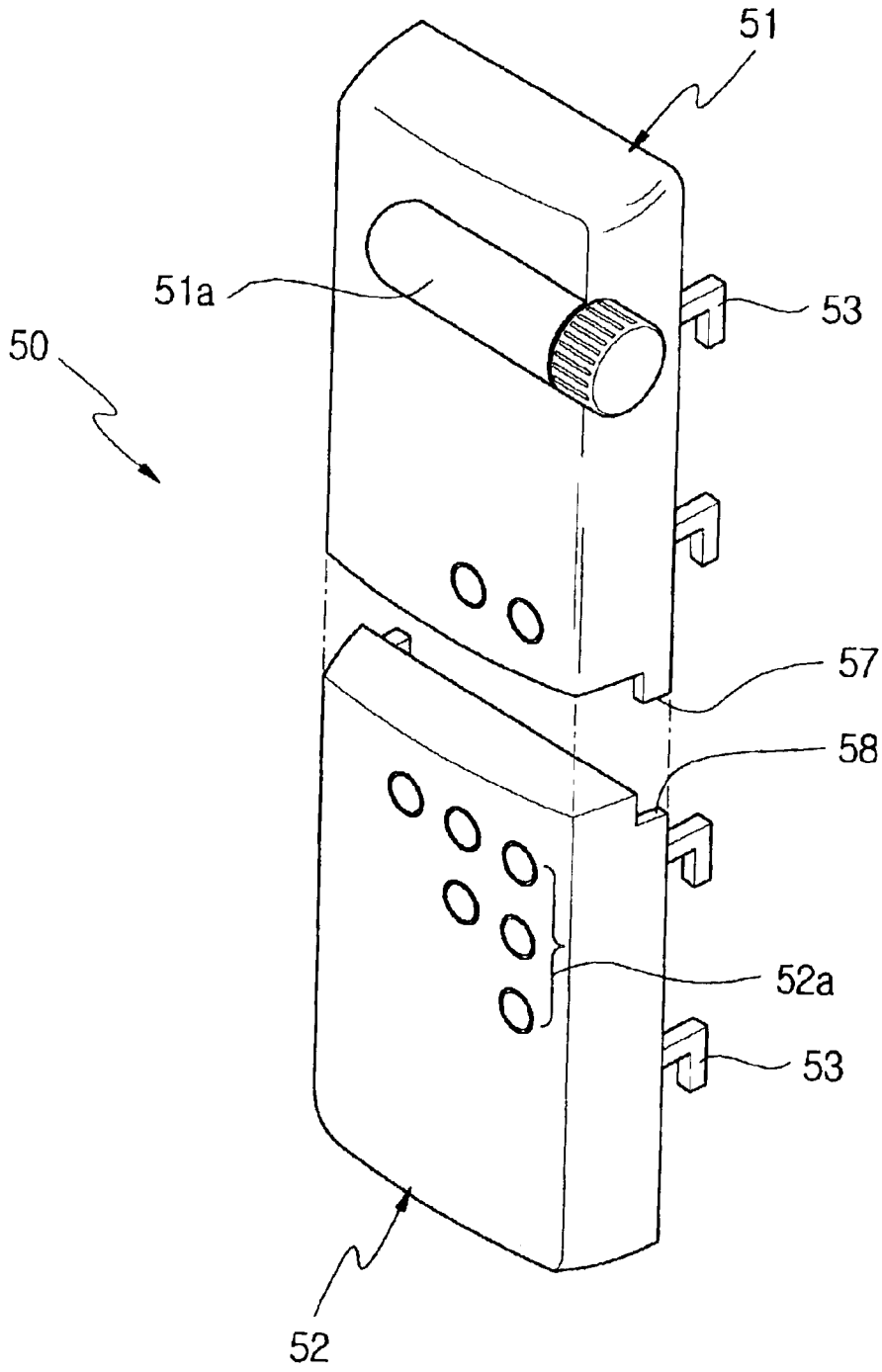
FIG. 3 is a perspective view illustrating the construction of the control panel of FIG. 2, having upper and lower panel parts.

FIG. 3 shows the construction of the control panel of FIG. 2. As shown in FIG. 3, the control panel 50 comprises the upper panel part 51 housing the display unit 51*a*, and the lower panel part 52 housing the manipulation unit 52*a*. The plurality of hooks 53 are formed along the rear surface of each of the side edges of each of the upper and lower panel parts 51 and 52, so as to attach the upper and lower panel parts 51 and 52 to the front wall 13 of the housing 10 through a hooking method described above.

A lower protrusion 57 is formed at a lower end of each of two sidewalls of the upper panel part 51, so as to extend downward from a rear portion of the lower end to a predetermined length. To engage with the lower protrusions 57 of the upper panel part 51, a recess 58 is formed on an upper end of each of two sidewall of the lower panel part 52 at a position corresponding to an associated protrusion 57.

Therefore, where the two panel parts 51 and 52 are attached to the front wall 13 of the housing 10, the lower panel part 52 is primarily attached to the front wall 13 by locking the hooks 53 of the lower panel part 52 into associated hooking holes 54 of the front wall 13, which are shown in FIG. 2. After the attachment of the lower panel part 52 to the front wall 13 of the housing 10, the hooks 53 of the upper panel part 52 are horizontally inserted into associated hooking holes 54 of the front wall 13 and the upper panel part 52 is pushed downward, thus locking the hooks 53 of the upper panel part 51 to the hooking holes 54 of the front wall 13. In such a case, the action of pushing the upper panel part 51 downward engages the lower protrusions 57 of the upper panel part 51 with the recesses 58 of the lower panel part 52, so as to stably attach the upper and lower panel parts 51 and 52 to the front wall 13 without being undesirably moved relative to each other.

Figure 4:
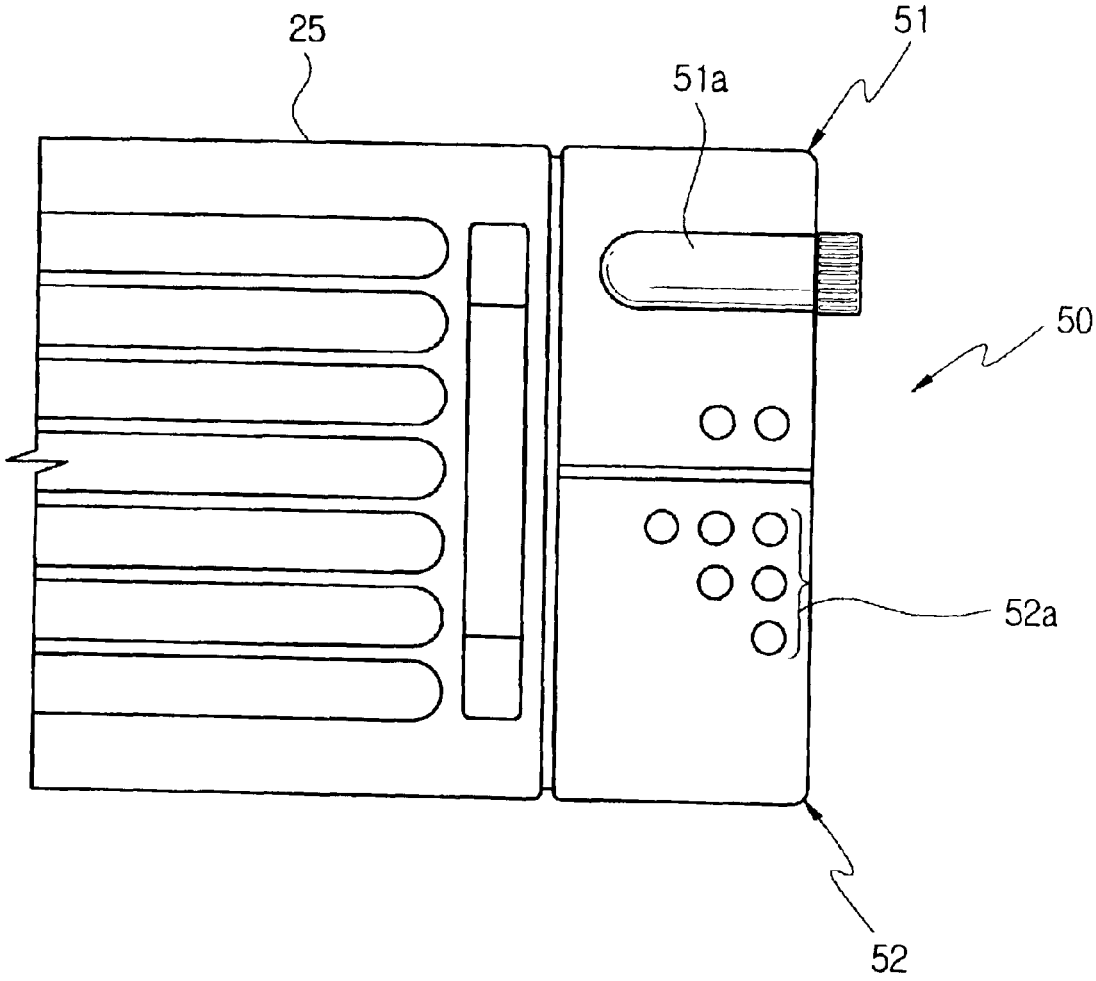
FIG. 4 is a partial front view of the microwave oven shown in FIG. 2.

FIG. 4 shows a partial front view of the microwave oven having the control panel shown in FIG. 2.

As shown in the drawing, the control panel 50 according to the present invention comprises the upper panel part 51 and the lower panel part 52, which are separate from each other. Accordingly, it is possible to provide upper and lower panel parts having different designs, features and colors, and customize a control panel by mixing and matching the upper and lower panel parts. In FIG. 4, the display unit 51*a* of the upper panel part 51 is designed so as to have a longitudinal rectangular shape, and the manipulation unit 52*a* of the lower panel part 52 is formed by arranging a plurality of pushbutton-type controls thereon.

Figure 5:
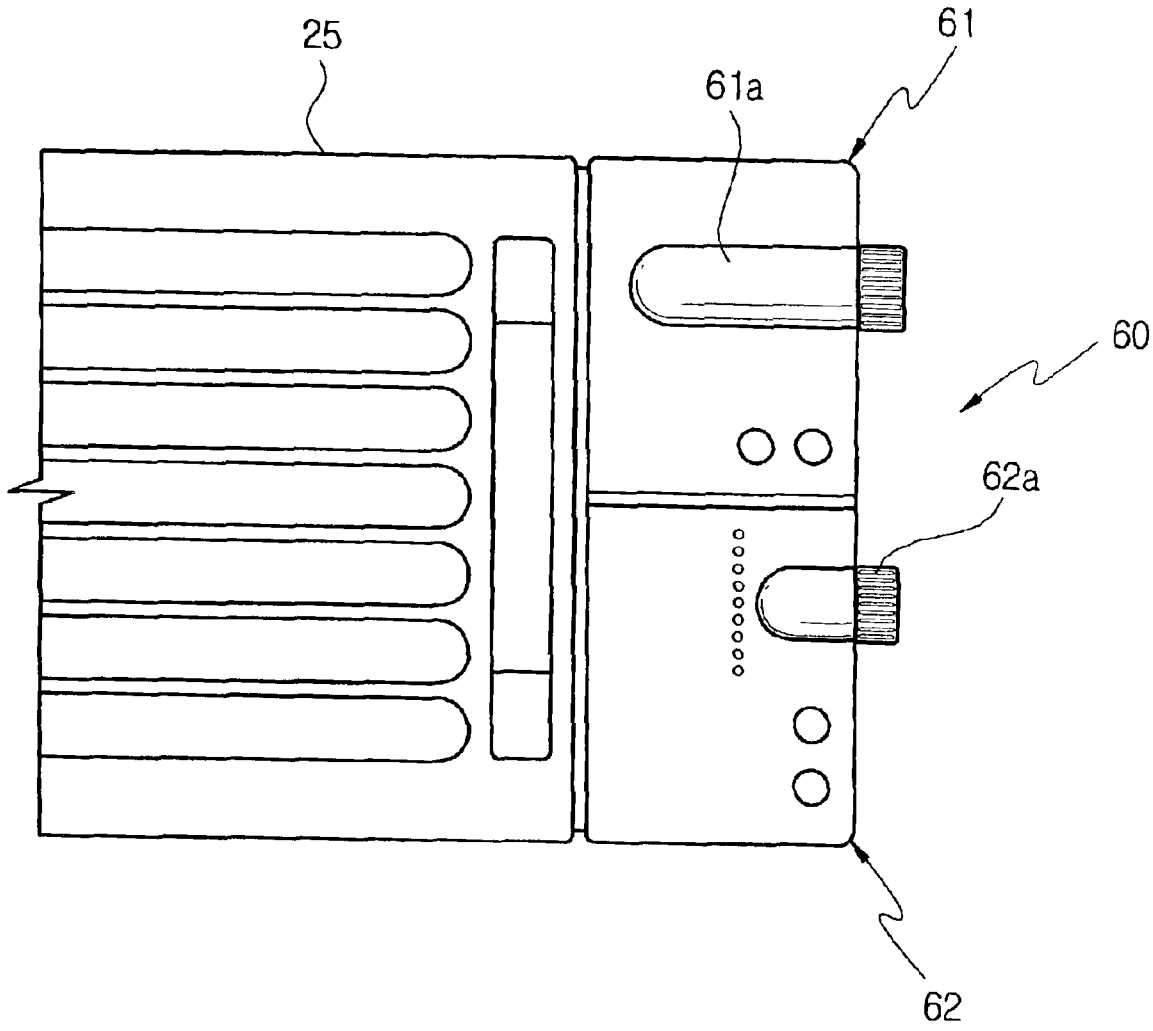
FIG. 5 is a partial front view of a microwave oven having a control panel according to another embodiment of the present invention.

FIG. 5 shows a partial view of a microwave oven having a control panel 60 according to another embodiment of the present invention.

As shown in the drawing, the control panel 60 comprises an upper panel part 61 and a lower panel part 62, which are separate from each other. In the present embodiment, a display unit 61*a* of the upper panel part 61 is designed in the same manner as that of the display unit 51*a* of FIG. 4. However, a manipulation unit 62*a* of the lower panel part 62 is designed as a dial-type control knob, and is different from the manipulation unit 52*a* of FIG. 4 having the pushbutton-type controls. Therefore, the control panel 60 has an appearance and a manipulation method thereof which are different from those of the control panel 50 shown in FIG. 4.

During the production of microwave ovens of the present invention, a plurality of upper panel parts 51 and 61 having a variety of appearances and a plurality of lower panel parts 52 and 62 having a variety appearances can be produced separately, and one of the upper panel parts 51 and 61 and one of the lower panel parts 52 and 62 can selected and combined to establish a control panel, prior to attaching the control panel to a front wall of a corresponding microwave oven. Therefore, it is possible to provide microwave ovens with variously and specifically designed control panels which meet the requirements of consumers who prefer products having specialized or customized designs over products with generic or limited designs. While only a few designs of upper and lower panel parts have been shown in FIGS. 4 and 5, it is understood that a variety of other designs, features and/or color may be provided. For example, while a manipulation unit of the lower panel part 52 or 62 is shown as a pushbutton-type 52*a* and a dial-type control knob 62*a*, other types of control units, including a rotary-type control knob, are possible.

As described above, the present invention provides a microwave oven with a control panel having upper and lower panel parts. During a production of the microwave oven, one of variously designed and separately produced upper panel parts, and one of variously designed and separately produced lower panel parts can be selected and combined prior to being attached to a front wall of the microwave oven. Accordingly, it is possible to provide microwave ovens with variously and specifically designed control panels which meet the requirements of consumers who prefer products with more customized designs and features over products with limited generic designs and features. The control panels according to the present invention thus enhance the market competitiveness of the microwave ovens.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A microwave oven, comprising:

a housing which establishes an appearance of the oven;

a heating unit to cook food;

a control panel mounted to a front wall of the housing, and comprises an upper panel part and a lower panel part which are separable from each other by manipulation of a protrusion in the upper panel part, or the lower panel part; and a recess which is formed in the corresponding lower panel part, or upper panel part, respectively for receiving the protrusion when the upper and lower panel parts are mounted to the housing.

2. The microwave oven according to claim 1, further comprising:

a display unit which is arranged on the upper panel part; and a manipulation unit which is arranged on the lower panel part, wherein the upper and lower panel parts having the display and manipulation units establish the control panel.

3. The microwave oven according to claim 2, wherein:

the upper panel part is selected from a plurality of pre-manufactured upper panel parts with corresponding display units having different appearances, and the lower panel part is selected from a plurality of pre-manufactured lower panel parts with corresponding manipulation units having different appearances and/or manipulation methods.

4. The microwave oven according to claim 2, further comprising:

a plurality of hooks which are formed along a rear surface of each of first and second side edges of each of the upper and lower panel parts; and a plurality of hooking holes which are formed on the housing so as to engage with the corresponding hooks of the upper and lower panel parts to mount the upper and lower panel parts to the housing.

5. The microwave oven according to claim 4, wherein:

the upper panel part includes a downward extending lower protrusion which is formed at a rear portion of a lower end of the upper panel part, the lower panel part includes a recess which is formed at a rear portion of an upper end of the lower panel part, and the recess receives the downward extending lower protrusion in response to the upper and lower panel parts being mounted to the housing.

6. The microwave oven according to claim 2, wherein:

the display unit displays cooking information of the oven, and the manipulation unit receives a cooking instruction therewith, and includes one or a combination of a pushbutton control unit, a touch screen control unit, a dial-type control knob unit, and a rotary-type control knob unit.

7. The microwave oven according to claim 6, wherein:

the upper panel part further includes a first printed circuit board associated with the display unit, and the lower panel part includes a second printed circuit board associated with the manipulation unit and electrically connected to the first printed circuit board.

8. The microwave oven according to claim 1, wherein the heating unit includes a magnetron which generates microwaves to cook the food.

9. The microwave oven according to claim 1, further comprising:

a display unit which is arranged on the lower panel part; and a manipulation unit which is arranged on the upper panel part, wherein the upper and lower panel parts having the display and manipulation units establish the control panel.

10. A cooking apparatus, comprising:

a housing which defines an appearance of the cooking apparatus;

a heating unit to cook food; and a control panel having at least a upper panel part and a lower panel part which are separable structures, wherein:

the upper panel part includes an extending protrusion which is formed at a portion of the upper panel part adjacent the lower panel part, the lower panel part includes a recess which is formed at a portion of the lower panel part adjacent the upper panel part, and the recess receives the downward extending lower protrusion when the upper and lower panel parts are mounted to the housing.

11. The cooking apparatus according to claim 10, wherein:

the upper panel part is selected from a plurality of pre-manufactured upper panel parts with corresponding display units having different appearances, and the lower panel part is selected from a plurality of pre-manufactured lower panel parts with corresponding manipulation units having different appearances and manipulation methods.

12. The cooking apparatus according to claim 11, wherein the manipulation unit includes one or a combination of a pushbutton control unit, a touch screen control unit, a dial-type control knob unit, and a rotary-type control knob unit.

13. The cooking apparatus according to claim 12, wherein the heating unit includes a magnetron which generates microwaves to cook the food.

14. The cooking apparatus according to claim 13, wherein the cooking apparatus is a microwave oven.

15. A cooking apparatus, comprising:

a housing which defines an appearance of the cooking apparatus;

a heating unit to cook food;

a door mounted to a first portion of a front wall of the housing;

a plurality of control panels which are mounted to corresponding areas of a second portion of the front wall;

a display unit which displays cooking information; and a manipulation unit for receiving a cooking instruction, wherein:

the plurality of control panels comprises first and second control panels, one of the display and manipulation units is provided to first control panel, the other of the display and manipulation units is provided to the second control panel, and the display unit and the manipulation unit are separable from each other, wherein:

the first control panel includes an extending protrusion which is formed at a portion of the first panel adjacent the second panel, the second control panel includes a recess which is formed at a portion of the second control panel adjacent the first control panel, and the recess receives the downward extending lower protrusion when the first and second control panels are mounted to the housing.

16. The cooking apparatus according to claim 15, wherein:

the first control panel is selected from a plurality of pre-manufactured control panels with corresponding display units having different appearances, and the second control panel is selected from a plurality of pre-manufactured control panels with corresponding manipulation units having different appearances manipulation methods.

17. The cooking apparatus according to claim 16, wherein the manipulation unit includes one or a combination of a pushbutton control unit, a touch screen control unit, a dial-type control knob unit, and a rotary-type control knob unit.

18. The cooking apparatus according to claim 17, wherein the heating unit includes a magnetron which generates microwaves to cook the food.

19. The cooking apparatus according to claim 18, wherein the cooking apparatus is a microwave oven.

20. A cooking apparatus, comprising:

a housing;

a heating unit to cook food; and a control panel mounted to a front wall of the housing, and which comprises a first panel part and a second panel part which is separate from the first panel part, wherein:

the first panel part includes an extending protrusion which is formed at a portion of the first panel part adjacent the second panel part, the second panel part includes a recess which is formed at a portion of the second panel part adjacent the first panel part, and the recess receives the downward extending lower protrusion when the first and second panel parts are mounted to the housing.

* * * * *

UNITED STATES PATENT AND TRADEMARK OFFICE

CERTIFICATE OF CORRECTION

PATENT NO. : 6,919,546 B2
DATED : July 19, 2005
INVENTOR(S) : Suk-Hee Lee

It is certified that error appears in the above-identified patent and that said Letters Patent is hereby corrected as shown below:

Column 8,
Line 34, after "appearances" insert -- and --.

Signed and Sealed this

Fourteenth Day of March, 2006

JON W. DUDAS
*Director of the United States Patent and Trademark Office*